US010883366B2

(12) United States Patent
Hussey et al.

(10) Patent No.: US 10,883,366 B2
(45) Date of Patent: Jan. 5, 2021

(54) MINE ROOF SUPPORT

(71) Applicant: Crosscut Enterprises LLC, Glassport, PA (US)

(72) Inventors: David A. Hussey, Pittsburgh, PA (US); George A. Watson, Prosperity, PA (US)

(73) Assignee: CROSSCUT ENTERPRISES LLC, Glassport, PA (US)

( * ) Notice: Subject to any disclaimer, the term of this patent is extended or adjusted under 35 U.S.C. 154(b) by 0 days.

(21) Appl. No.: 16/662,246

(22) Filed: Oct. 24, 2019

(65) Prior Publication Data

US 2020/0131905 A1 Apr. 30, 2020

Related U.S. Application Data

(60) Provisional application No. 62/750,029, filed on Oct. 24, 2018.

(51) Int. Cl.

| | |
|---|---|
| ***E21D 15/02*** | (2006.01) |
| ***E21D 15/48*** | (2006.01) |
| ***E21D 15/00*** | (2006.01) |

(52) U.S. Cl.
CPC ..... *E21D 15/48* (2013.01); *E21D 15/005* (2013.01); *E21D 15/02* (2013.01)

(58) Field of Classification Search
CPC ..... E21D 15/48; E21D 15/005; E21D 15/02
See application file for complete search history.

(56) References Cited

U.S. PATENT DOCUMENTS

| | | | | |
|---|---|---|---|---|
| 1,895,053 A | | 1/1933 | Staley | |
| 3,949,877 A | | 4/1976 | Santoni | |
| 4,255,071 A | * | 3/1981 | Koppers | E21D 15/02 248/354.1 |
| 4,277,204 A | * | 7/1981 | Koppers | E21D 15/02 405/288 |
| 4,281,487 A | | 8/1981 | Koller | |
| 4,534,531 A | | 8/1985 | Brown | |

(Continued)

OTHER PUBLICATIONS

Arjun, Neenu; Bamboo Reinforced Concrete—Properties, Mix Proportions, Design and Construction; All; Dec. 2016 (Year: 2016).*

(Continued)

*Primary Examiner* — Benjamin F Fiorello
(74) *Attorney, Agent, or Firm* — Spilman Thomas & Battle PLLC; William P. Smith

(57) ABSTRACT

A system or method for a structural mine roof support includes a roof support apparatus that includes a cylindrical cladding defining a hollow interior, a plurality of bamboo sections disposed in the hollow interior and coaxial with an axis of the cylinder. Also, a roof support apparatus with a cylindrical cladding defining a hollow interior, a plurality of bamboo sections disposed in the hollow interior and coaxial with an axis of the cylinder, and voids between adjacent bamboo sections, the voids being injected with a filler material, e.g., polyurethane foam, to maintain axial positioning of the bamboo sections when under load. The support apparatus configured to load and to yield in a predetermined fashion to control a mine roof from sudden failure.

20 Claims, 9 Drawing Sheets

(56) References Cited

U.S. PATENT DOCUMENTS 4,565,469 A * 1/1986 Chlumecky ..... E21D 15/005 405/273
4,712,947 A 12/1987 Thom
4,909,393 A 3/1990 Palisin, Jr.
4,915,339 A 4/1990 Halbich
5,308,196 A * 5/1994 Frederick ..... E21D 15/483 248/354.2
5,318,387 A 6/1994 Pienaar et al.
5,746,547 A * 5/1998 Reinmann ..... E21D 15/04 299/11
5,868,527 A 2/1999 King et al.
5,921,718 A * 7/1999 Kolk ..... E21D 15/18 248/354.2
6,558,085 B1 5/2003 Hall
6,910,834 B2 6/2005 Harbaugh et al.
7,097,389 B1 * 8/2006 Skidmore ..... E21D 15/48 299/11
7,503,731 B2 3/2009 Seegmiller
8,801,338 B2 8/2014 Hussey
9,683,361 B2 * 6/2017 Timberlake ..... E04C 5/0604
2003/0207098 A1 * 11/2003 Ryan ..... B27N 5/00 428/297.4
2006/0133899 A1 6/2006 Seegmiller
2010/0135732 A1 * 6/2010 Skarbovig ..... E04G 21/0472 405/289
2010/0247249 A1 * 9/2010 Skarbovig ..... E21D 15/483 405/289
2011/0262231 A1 * 10/2011 Hussey ..... E21D 15/483 405/289
2012/0269585 A1 * 10/2012 Faulkner ..... E21D 15/483 405/289
2013/0129426 A1 * 5/2013 Skarbovig ..... E21D 15/483 405/288
2013/0136545 A1 * 5/2013 Hussey ..... E21D 15/48 405/288
2014/0348596 A1 * 11/2014 Hussey ..... E21D 15/502 405/288
2015/0147122 A1 5/2015 Faulkner et al.
2015/0184512 A1 7/2015 Shook et al.
2016/0061032 A1 3/2016 Shook
2019/0203597 A1 7/2019 Abel et al.

OTHER PUBLICATIONS

International Search Report dated May 16, 2017 in International Application No. PCT/US2017/19079 filed Feb. 23, 2017.

* cited by examiner

MINE ROOF SUPPORT

CROSS REFERENCE TO RELATED PATENT APPLICATIONS

This application claims priority to, and the benefit of U.S. Provisional Patent Application Ser. No. 62/750,029 filed Oct. 24, 2018, entitled "Mine Roof Support", which is hereby incorporated by reference.

BACKGROUND

The application generally relates to a load bearing support. The application relates more specifically to a load bearing support constructed of bamboo core with an external cladding for mine roof supports.

Bamboo is a giant grass characterized by a generally cylindrical, hollow shell. Bamboo is one of the fastest growing plants, making it a sustainable, easily replaced commodity. Bamboo shells are high strength in the direction parallel to the fibers. It may be used like wood beams for construction in some cases, particularly in South East Asian countries where bamboo is most plentiful. Bamboo has also been used as reinforcement for concrete in those areas where it is plentiful, though untreated bamboo swells and cracks due to water being absorbed from the concrete.

Various devices disclosed in the prior art are designed and used to provide support to a mine roof. Underground mining results in removal of material from the interior of a mine, thereby leaving unsupported passageways of various sizes within the mine. The lack of support in such passageways may cause mine roof buckling and/or collapse. Thus, it has been desirable to provide support to mine roofs to prevent, delay, or control collapse thereof.

In both underground mining and areas of seismic activity, supports must be engineered to withstand enormous forces propagating through the earth. Building and bridge structures may include modified foundations designed to isolate the superstructure from major ground motion during an earthquake. Such supports for building structures are intended to avoid the transmission of high seismic forces.

Bridges and building structures which are located in an earthquake zone are capable of being damaged or destroyed by seismic forces. In general bridge structures may be constructed with bearings between the bridge's deck or superstructure and the bridge supporting columns to permit relative movement between the two. It is also known to provide damping for the movement upon these bearings of superstructure relative to supports, however the permitted relative movement is not large and furthermore it is not always preferred to attempt to hold a superstructure in a position around a neutral point with respect to the supports.

Because of problems associated with catastrophic failure of posts, various mine props have been developed in the art for supporting the roof of an underground mine. Such mine props have included, various configurations of wood beams encased in metal housings, and complex hydraulically controlled prop devices. Such props, however, do not allow for controlled axial yielding while preventing sideways buckling or kneeling in a simple, lightweight prop that can be hand carried by a user.

Heretofore bamboo has not been used as a vertical load bearing support in large structures or massive loads, e.g., underground mine roof support conditions, due to limitations in lateral strength.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to a roof support apparatus including a cylindrical cladding defining a hollow interior, a plurality of bamboo sections disposed adjacent one another in the hollow interior and coaxial with an axis of the cylinder.

Another embodiment relates to a roof support apparatus including a cylindrical cladding defining a hollow interior, a plurality of bamboo sections disposed in the hollow interior and coaxial with an axis of the cylinder, and voids between adjacent bamboo sections, the voids being injected with a filler material, e.g., polyurethane foam, to maintain axial positioning of the bamboo sections when under load. The support apparatus configured to load and to yield in a predetermined fashion to control a mine roof from sudden failure.

Testing has disclosed great success with bamboo integrated into containers, or cladding, of steel and other tubular products. Filling the void space between the bamboo pieces and the cladding with polyurethane foam provides even higher yield strength for ensuring integrity of mine roof support.

Certain advantages of the embodiments described herein include a controlled yielding of the bamboo support without releasing the load, up to at least 200 tons and to as much as 300 tons.

Another advantage is the ability to use the disclosed drum support in various applications including underground mining, bridge construction and repair, and seismic supports for buildings and other structures, as permanent or temporary load supports for very large loads, using inexpensive materials and assembly methods.

Another advantage is the use of an inexpensive, sustainable bamboo composite member to provide high strength load bearing supports.

Still another advantage is the reduced weight of the bamboo-filled drum support enables shipping more supports one a vehicle and reduces fuel consumption. Also, the lighter drum support is safer for personnel for handling.

Further advantage is realized by the bamboo drum support in a cylindrical drum due to improved aerodynamics compared with conventional rectangular mine roof supports that restrict airflow, thereby reducing the wind resistance load on ventilation motors while improving the efficiency of the ventilation system.

Alternative exemplary embodiments relate to other features and combinations of features as may be generally recited in the claims.

BRIEF DESCRIPTION OF THE FIGURES

The application will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
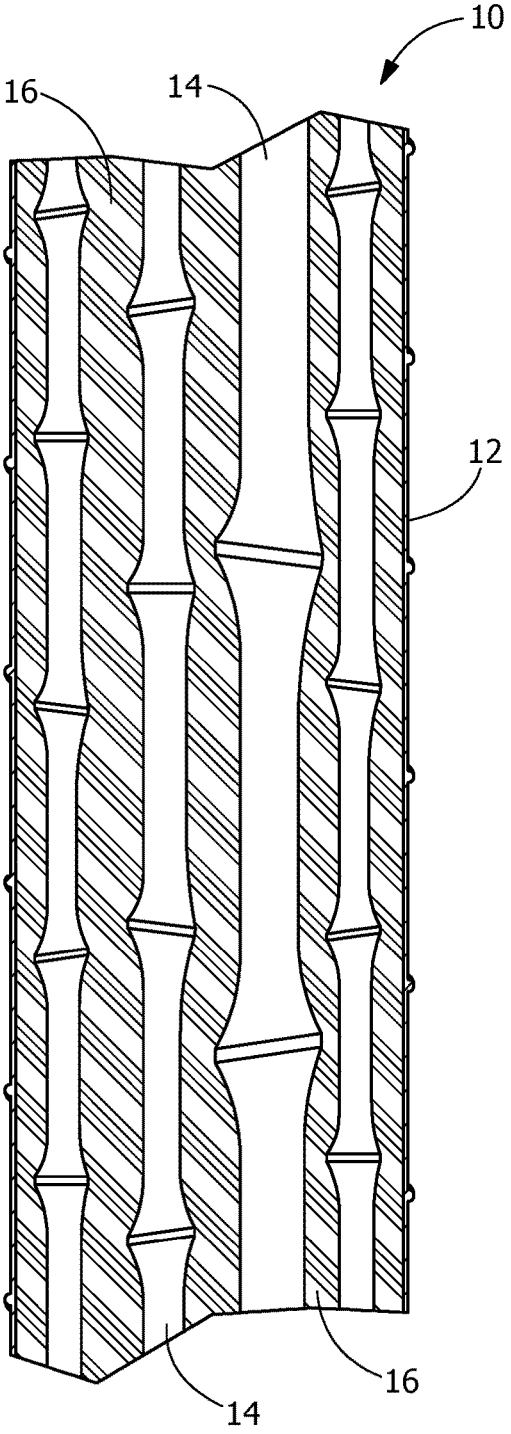
FIG. 1 is a partial, cross-sectional elevational view of an exemplary embodiment of a roof support.

Referring to FIG. 1, a partial, cross-sectional elevational view of an exemplary embodiment of a roof support 10 is shown. Roof support 10 includes an external cladding 12, extending longitudinally and defining a hollow interior space filled with multiple bamboo sections 14 placed coaxially within the interior of cladding 12. Bamboo sections 14 having various radii provide voids 16 interspersed within support 10. Voids 16 may be left empty, or may be filled with polyurethane foam or other binders to retain stability or increase load bearing capacity of roof support 10, as will be described in greater detail below.

Figure 2:
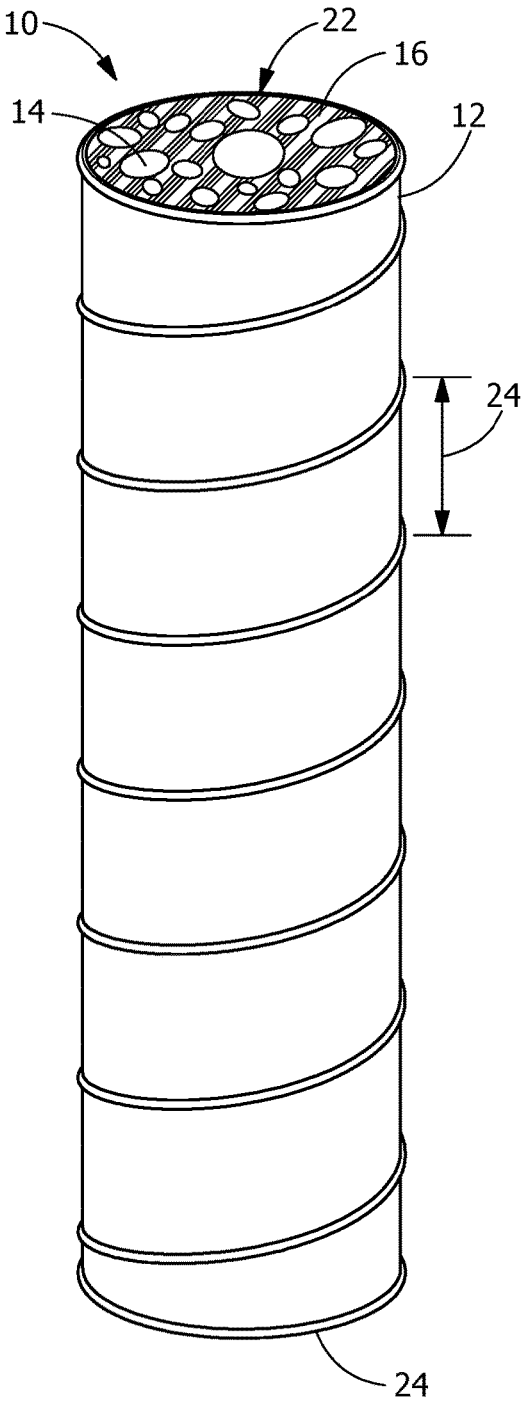
FIG. 2 is an exemplary embodiment of the roof support.

Referring next to FIG. 2, support 10 has a top end 22 and bottom end 24 and may be substantially open or covered by an end cap. Top end 22 is generally positioned adjacent a mine roof or other load, either directly or with a yield ring inserted between the support and the load, and bottom end 24 in direct contact with a floor or other structure. Cladding 12 has bamboo sections 14 extending substantially the entire length of the support 10. In the embodiment of FIG. 2, cladding 12 may be formed of spiral tubing of a predetermined pitch, e.g., 5 inches (or 12.7 cm), although the pitch of the spiral tubing may be varied to achieve various design criteria for the support 10.

Roof support 10 may be used as a single support or stacked as needed to obtain the desired height. In various embodiments a yield ring, beam, footing or wedges may be inserted on top of the roof support 10 to take up any gap between the roof support 10 and the mine roof or other surface, such that the weight of the mine roof is transferred to the roof support 10. Other shims may include pumpable containment structures (e.g., bags) or a pumpable telescoping structure such as disclosed in U.S. Pat. No. 6,394,707, incorporated herein by reference.

Figure 3:
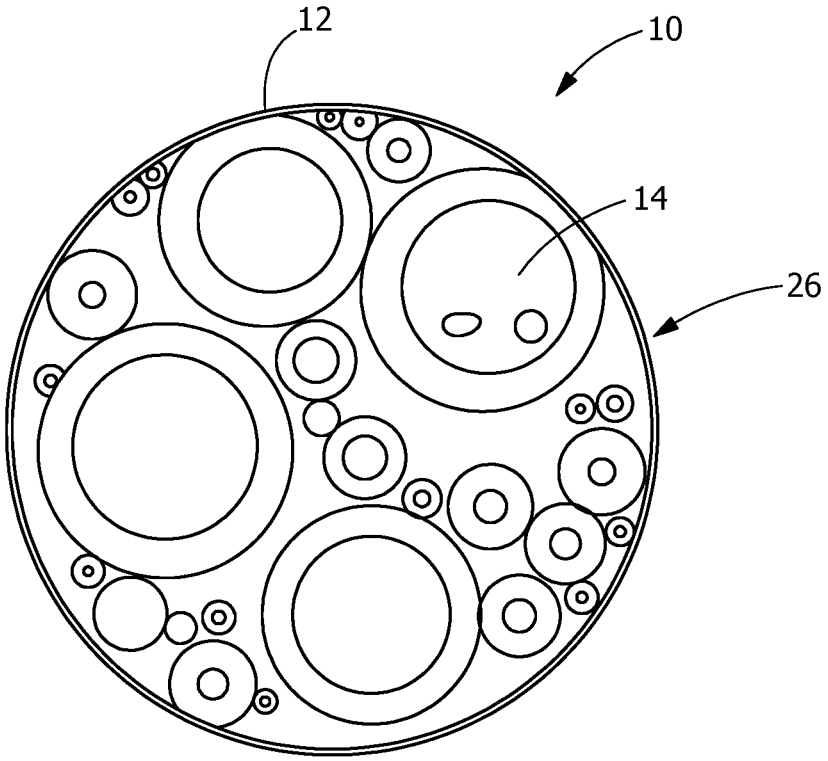
FIG. 3 is an exemplary support having bamboo sections of various diameters disposed within the interior space of cladding.

Referring next to FIG. 3, a support 10 is shown having bamboo sections 14 of various diameters disposed within the interior space 26 of cladding 12. In the embodiment of FIG. 3, bamboo sections 14 include small, medium and large diameter sections interspersed randomly within space 26, so that a majority of the interior space is taken up by bamboo sections 14. This arrangement provides voids between bamboo sections 14, but maintains a generally vertical or coaxial alignment inside cladding 12.

Figure 4:
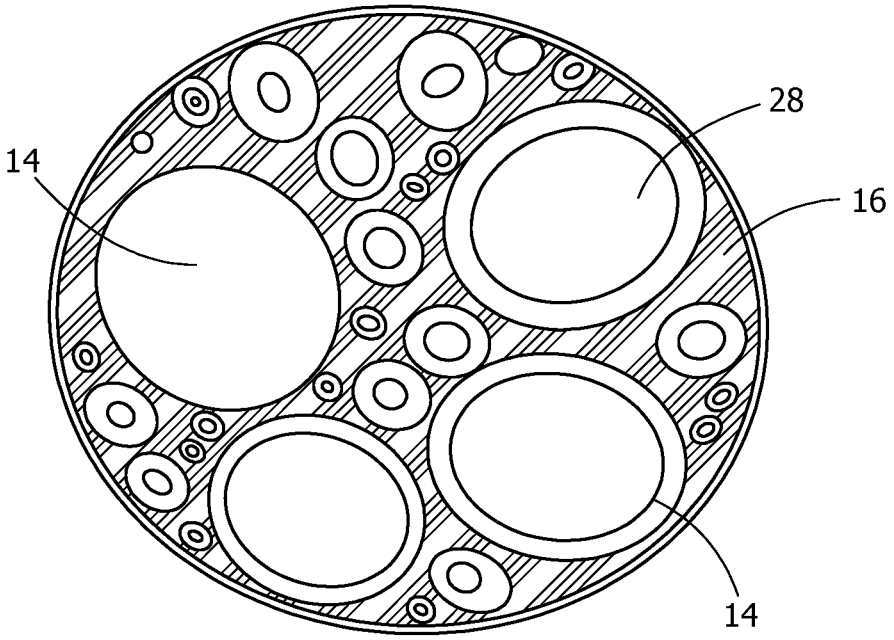
FIG. 4 is another exemplary embodiment of the roof support with voids filled with PUR foam.

FIG. 4 shows another embodiment of a roof support 10, wherein the voids 16 are filled with PUR foam. The hollow cores 28 of bamboo sections 14 are unfilled, i.e., remain hollow as indicated in FIG. 4, although in other embodiments the hollow cores 28 may also be filled with PUR foam for additional strength if desired.

Figure 5:
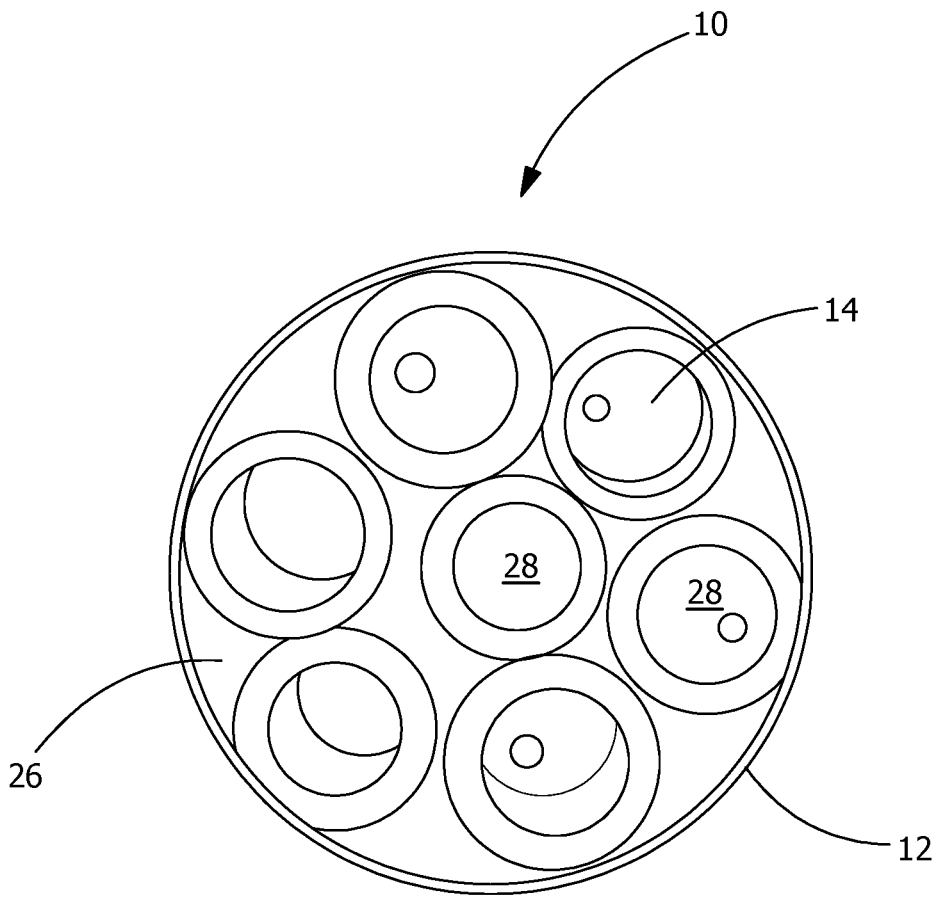
FIG. 5 shows an end view of a roof support with uniform diameter bamboo sections arranged within the external cladding.

FIG. 5 shows an end view of a roof support 10 with more uniform diameter bamboo sections 14 arranged within cladding 12. Voids 26 are empty, i.e., air, in FIG. 5, although filler material may be inserted therein if desired. In the embodiments shown in the figures, PUR foam is generally used as filler in voids 26, however other material may be used instead, e.g., pea gravel, sand or other flowable material.

Figure 6:
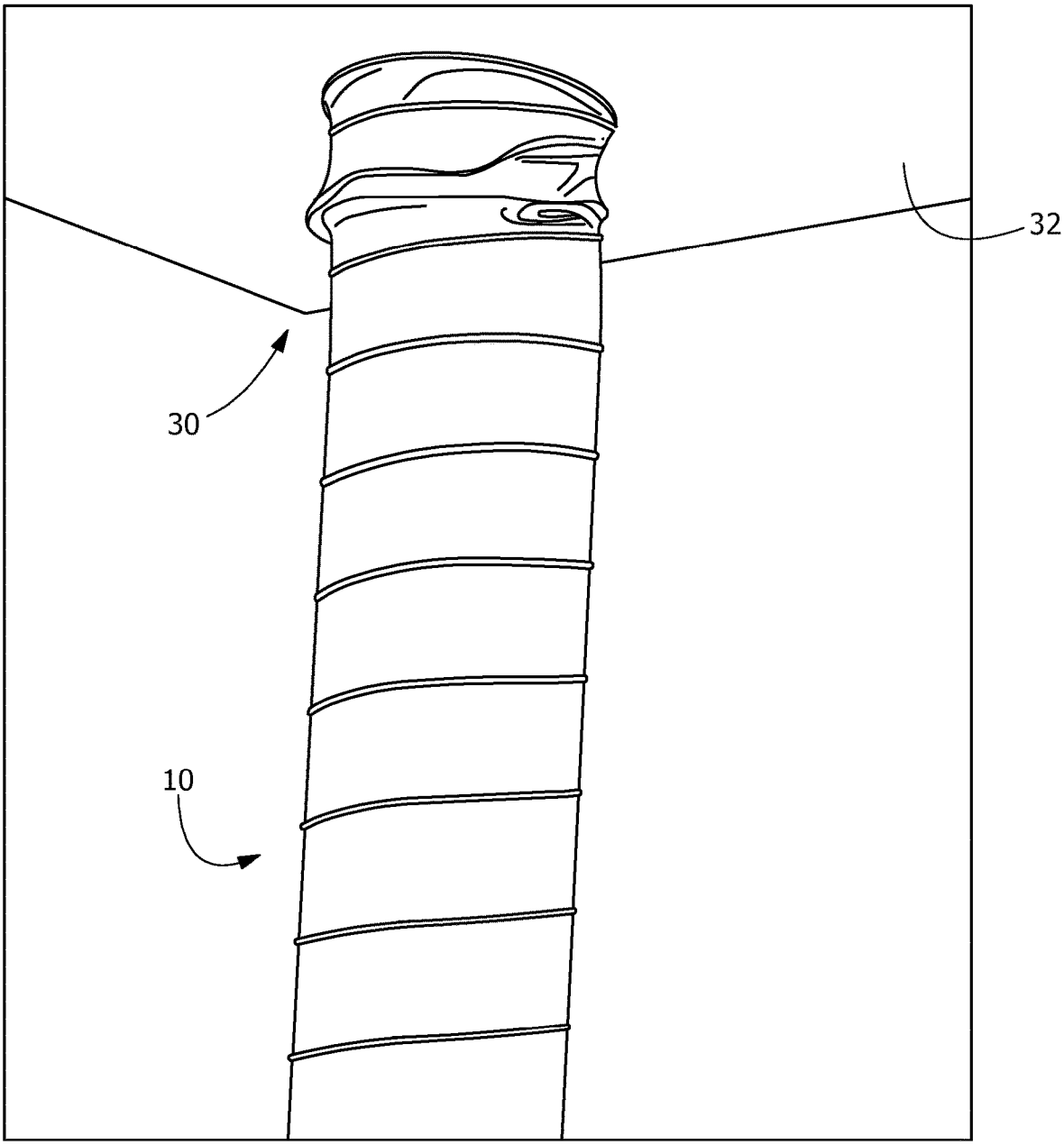
FIG. 6 shows a test facility for an exemplary roof support.

FIG. 6 shows a test facility for an exemplary roof support 10, wherein a load is applied hydraulically to compress the support under extreme load. In FIG. 6 the top section 30 is shown deforming under the applied load, without failing. This configuration simulates a mine roof environment 32 wherein the deformation is controlled to prevent sudden collapse of the mine roof.

Figure 7:
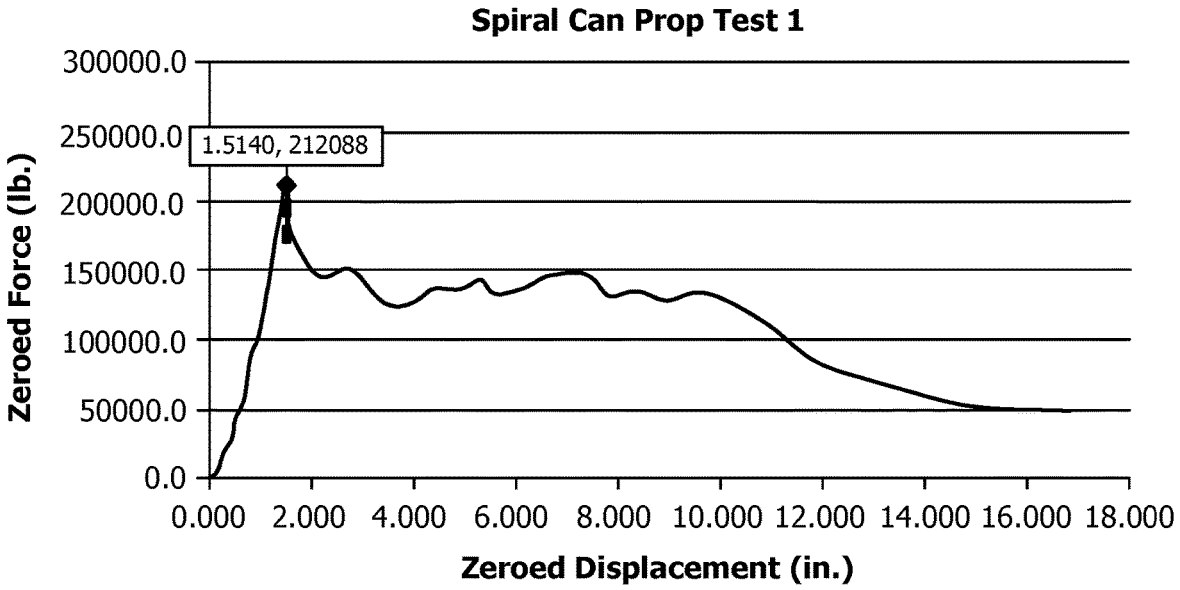
FIG. 7 is a graphs of a load profile of one embodiment of the roof support.

FIG. 7 shows a graphical profile of a first exemplary test, showing compressive force versus displacement for a roof support. Support 10 in this test was 12 inch diameter by 60 inch long. The voids in the cladding are filled with PUR around the bamboo. Table 1 below shows the parameters related to FIG. 7. Note that the peak tonnage is indicated as 106 tons, or 212088 lbs. [Metric units 96161 kg].

TABLE 1

| | | | |
|---|---|---|---|
| Sample Number | 1 | Trigger Force Setting (lb.) | 593.8 |
| Specimen ID | Spiral Can Prop Test | Scan Number | 31 |
| Sample Dia. (in.) | 12.00 | Trigger Time (sec.) | 3.100 |
| Water to Solids Ratio | 0.00 | Trigger Force Actual (lb.) | 358.60 |
| Sample Lgth. (in.) | 60.00 | Trigger Displacement (in.) | −0.00319 |
| Cylinder Weight (lb.) | 96 | Peak Scan Number | 1812 |
| Sample Vol. ($in^3$) | 6785.84 | Peak Load (lb.) | 212088 |
| Sample Vol. ($Ft^3$) | 3.9270 | Peak Pressure (psi) | 1875 |
| Density (lb./$Ft^3$) | 24.45 | Compressive Modulus (psi) | 74317 |
| Date Prepared | Aug. 7, 18 | Extension Test Delta (in.) | 1.51399 |
| Date Tested | Aug. 8, 2018 16:53 | Loading Rate (psi/min) | 621.0 |
| Fracture Pattern | 0 | Peak Strain (%) | 2.523 |
| User Defined 8 | 0.00 | Sample Area ($in^2$) | 113.097 |
| UD Ratio | 5.000 | | |
| Correction Factor | 1.0000 | | |

Total Peak Tons 106

Figure 8:
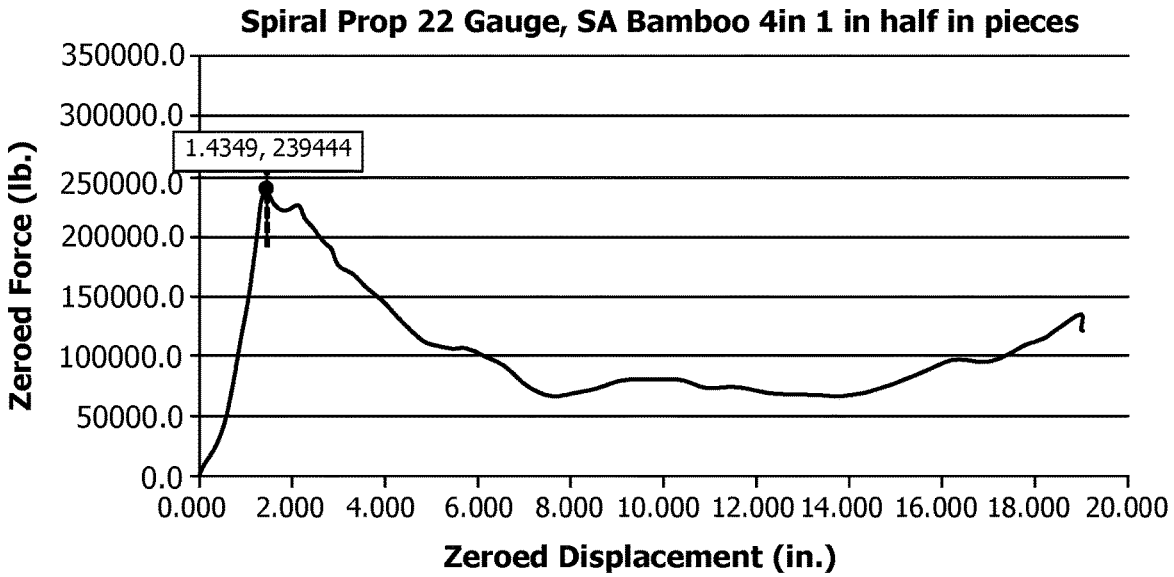
FIG. 8 is a graphs of a load profile of a second embodiment of the roof support.

FIG. 8 shows a graphical profile of a second exemplary test with an embodiment of the bamboo support wherein the spiral cladding is formed from 22 gauge sheet steel with South American bamboo in pieces ranging from 1 inch to 4 inches (2.54 to 10.16 cm). The voids in the cladding are filled with PUR around the bamboo. In the embodiment tested some sections of bamboo were not continuous over the length of the support but arranged in pieces along the axial length.

Table 2 below shows the test parameters related to FIG. 8. Note that the peak load for the test parameters was approximately 120 tons.

TABLE 2

| | | | |
|---|---|---|---|
| Sample Number | 2 | Trigger Force Setting (lb.) | 1745.5 |
| Specimen ID | Gauge, SA Bamboo 4 in. | Scan Number | 82 |
| Sample Dia. (in.) | 12.00 | Trigger Time (sec.) | 8.200 |
| Water to Solids Ratio | 0.00 | Trigger Force Actual (lb.) | 1647.99 |
| Sample Lgth. (in.) | 6.00 | Trigger Displacement (in.) | 0.09144 |
| Cylinder Weight (lb.) | 126 | Peak Scan Number | 1948 |
| Sample Vol. ($in^3$) | 678.58 | Peak Load (lb.) | 239444 |
| Sample Vol. ($Ft^3$) | 0.3927 | Peak Pressure (psi) | 1228 |
| Density (lb./$Ft^3$) | 320.86 | Compressive Modulus (psi) | 8853 |
| Date Prepared | Aug. 30, 18 | Extension Test Delta (in.) | 1.43490 |
| Date Tested | Aug. 31, 2018 15:05 | Loading Rate (psi/min) | 652.1 |
| Fracture Pattern | 0 | Peak Strain (%) | 23.915 |
| User Defined 8 | 0.00 | Sample Area ($in^2$2) | 113.097 |

Figure 9:
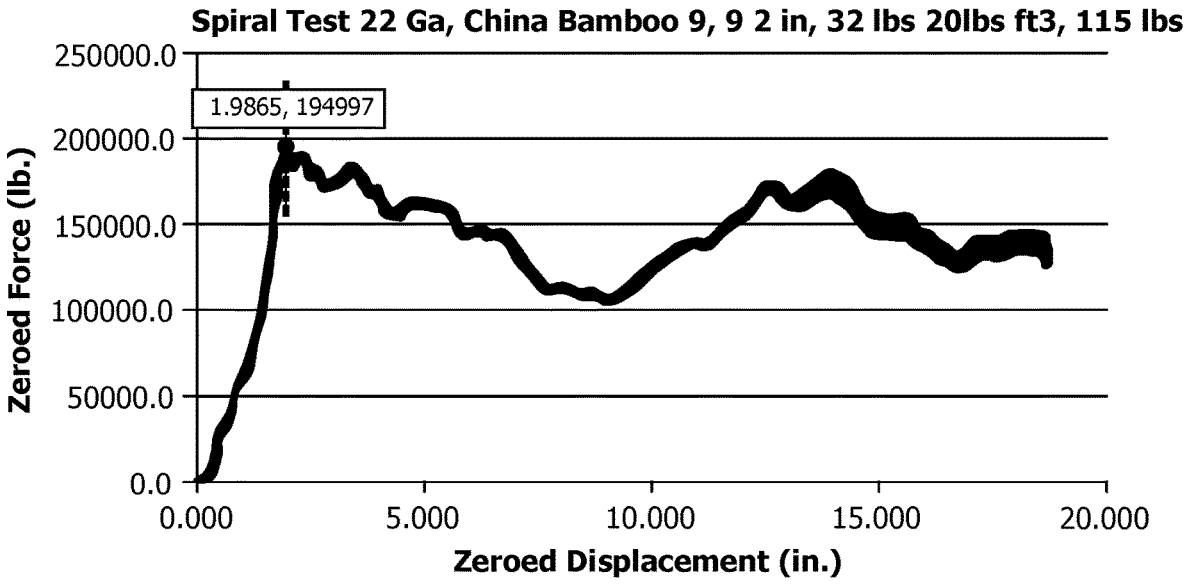
FIG. 9 is another a graphs of a load profile of a third embodiment of the roof support.

FIG. 9 shows a graphical profile of a third exemplary test with an embodiment of the bamboo support wherein the spiral cladding is formed from 22 gauge sheet steel with China bamboo with 9 pieces of 3 inch (7.6 cm) diameter and 9 pieces of 2 inch (5.1 cm) diameter, full 6 ft. length sections. The voids in the cladding are filled with PUR around the bamboo. In the embodiment tested some sections of bamboo were not continuous over the length of the support but arranged in pieces along the axial length.

Table 3 below shows the test parameters related to FIG. 9. Note that the peak load for the test parameters was approximately 97.5 tons.

TABLE 3

| | | | |
|---|---|---|---|
| Sample Number | 3 | Baseline Force Setting (lb.) | −1530.1 |
| Specimen ID | Bamboo 9, 3 inch | Baseline Set Scan Number | 2 |
| Sample Dia. (in.) | 12.00 | Baseline Set Time (sec.) | 0.200 |
| Water to Solids Ratio | 0.00 | Baseline Force Actual (lb.) | −1554.51 |
| Sample Lgth. (in.) | 72.00 | Baseline Displacement (in.) | 1.01725 |
| Cylinder Weight (lb.) | 115 | Peak Scan Number | 1861 |
| Sample Vol. ($in^3$) | 8143.01 | Peak Load (lb.) | 194997 |
| Sample Vol. ($Ft^3$) | 4.7124 | Peak Pressure (psi) | 1724 |
| Density (lb./$Ft^3$) | 24.40 | Compressive Modulus (psi) | 62490 |
| Date Prepared | Aug. 30, 18 | Extension Test Delta (in.) | 1.98653 |
| Date Tested | Aug. 31, 2018 16:35 | Loading Rate (psi/min) | 555.9 |
| Fracture Pattern | 0 | Peak Strain (%) | 2.759 |
| User Defined 8 | Bamboo from CN | Sample Area (in2) | 113.097 |
| L/D Ratio | 6.000 | | |
| Correction Factor | 1.0000 | | |

Figure 10:
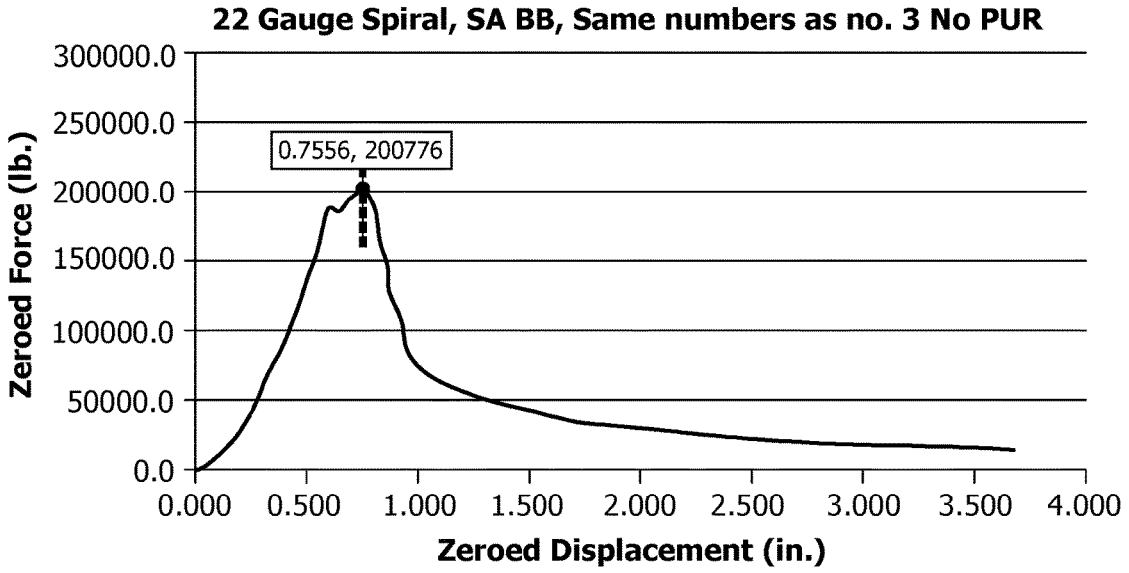
FIG. 10 is a graphs of a load profile of a fourth embodiment of the roof support.

FIG. 10 shows a graphical profile of a fourth exemplary test with an embodiment of the bamboo support wherein the spiral cladding is formed from 22 gauge sheet steel with South American bamboo with 9 pieces of 3 inch (7.6 cm) diameter and 9 pieces of 2 inch (5.1 cm) diameter, full 6 ft. length sections, with no PUR or other filler. In the embodiment tested some sections of bamboo were not continuous over the length of the support but arranged in pieces along the axial length.

Table 4 below shows the test parameters related to FIG. 10. Note that the peak load for the test parameters was approximately 100 tons.

TABLE 4

| | | | |
|---|---|---|---|
| Sample Number | 4 | Baseline Force Setting (lb.) | 517.4 |
| Specimen ID | BB Same number | Baseline Set Scan Number | 27 |
| Sample Dia. (in.) | 12.00 | Baseline Set Time (sec.) | 2.700 |
| Water to Solids Ratio | 0.00 | Baseline Force Actual (lb.) | 159.50 |
| Sample Lgth. (in.) | 72.00 | Baseline Displacement (in.) | −0.00034 |
| Cylinder Weight (lb.) | 113 | Peak Scan Number | 933 |
| Sample Vol. ($in^3$) | 8143.01 | Peak Load (lb.) | 200776 |
| Sample Vol. ($Ft^3$) | 4.7124 | Peak Pressure (psi) | 1775 |
| Density (lb./$Ft^3$) | 23.98 | Compressive Modulus (psi) | 169154 |
| Date Prepared | Sep. 5, 18 | Extension Test Delta (in.) | 0.75563 |
| Date Tested | Sep. 6, 2018 13:21 | Loading Rate (psi/min) | 1141.6 |
| Fracture Pattern | 0 | Peak Strain (%) | 1.049 |
| User Defined 8 | Same test as Test 3 | Sample Area ($in^2$) | 113.097 |
| L/D Ratio | 6.000 | | |
| Correction Factor | 1.0000 | | |

Figure 11:
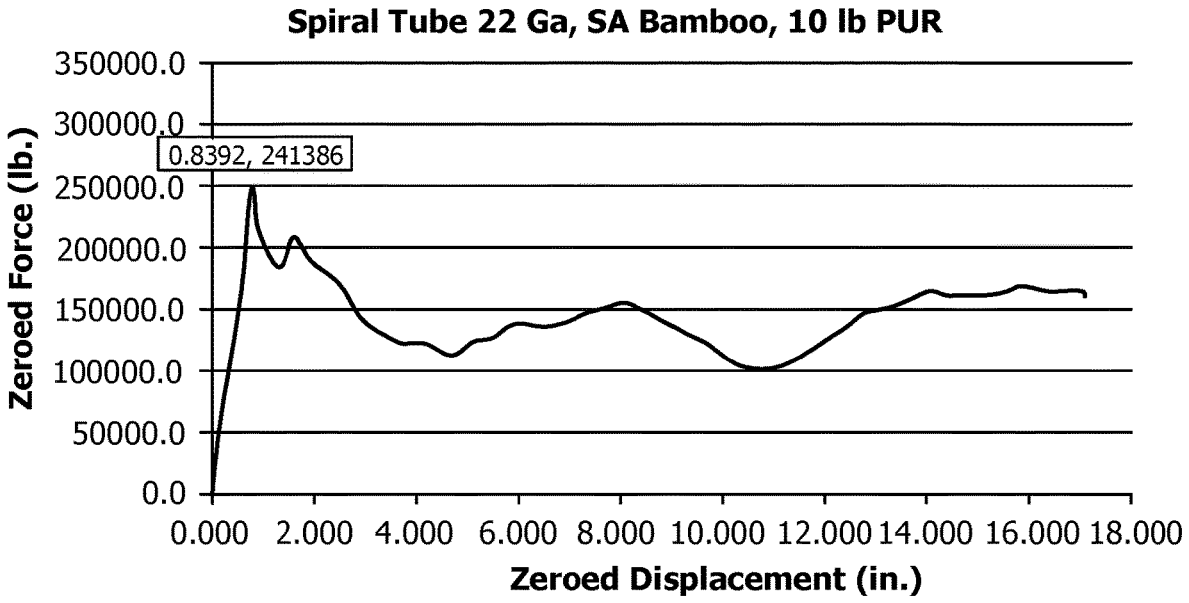
FIG. 11 is a graphs of a load profile of a fifth embodiment of the roof support.

FIG. 11 shows a graphical profile of a fifth exemplary test with an embodiment of the bamboo support wherein the spiral cladding is formed from 22 gauge sheet steel with South American bamboo, with voids filled with PUR foam having a density of 10 lbs./$ft^3$. Tests 1 through 3 above used a higher density (20 lbs./$ft^3$) PUR foam filler material.

Table 5 below shows the test parameters related to FIG. 11. Note that the peak load for the test parameters was approximately 120 tons.

TABLE 5

| | | | |
|---|---|---|---|
| Sample Number | 5 | Baseline Force Setting (lb.) | −234.5 |
| Specimen ID | 22 GA, SA Bamboo | Baseline Set Scan Number | 13 |
| Sample Dia. (in.) | 12.00 | Baseline Set Time (sec.) | 1.300 |
| Water to Solids Ratio | 0.00 | Baseline Force Actual (lb.) | −287.48 |
| Sample Lgth. (in.) | 72.00 | Baseline Displacement (in.) | −0.00236 |
| Cylinder Weight (lb.) | 122.5 | Peak Scan Number | 1057 |
| Sample Vol. ($in^3$) | 8143.01 | Peak Load (lb.) | 241386 |
| Sample Vol. ($Ft^3$) | 4.7124 | Peak Pressure (psi) | 2134 |
| Density (lb./$Ft^3$) | 26.00 | Compressive Modulus (psi) | 183124 |
| Date Prepared | Aug. 7, 18 | Extension Test Delta (in.) | 0.83916 |
| Date Tested | Sep. 7, 2018 13:42 | Loading Rate (psi/min) | 1211.5 |
| Fracture Pattern | 0 | Peak Strain (%) | 1.166 |
| User Defined 8 | d the density down | Sample Area ($in^2$) | 113.097 |
| LID Ratio | 6.000 | | |
| Correction Factor | 1.0000 | | |

As indicated by the test results in FIGS. 6 through 11, and Tables 1 through 5, high strength cylindrical supports or props are achieved using lightweight structural components, i.e., bamboo and PUR foam, which are inexpensive to assemble and transport. This is particularly advantageous in difficult to reach areas such as underground mines. The cladding material disclosed in the exemplary embodiments is made from sheet steel in a spiral configuration, having a pitch of about 5 inches. The invention is not limited to steel cladding, as it is possible to use various materials, such as plastics, tube steel, copper, aluminum or any material capable of being shaped or fabricated as a tubular member. By varying the elastic properties of the cladding, deformation and loading may be controlled in a predetermined profile as set forth in various profiles shown in FIGS. 7 through 11.

The configuration and load capacity of supports may be increased by binding multiple supports together, e.g., three supports 10 may be used in place of conventional timber cribbing. Alternately the cladding may have a larger diameter to achieve an equivalent capacity as the multiple support configuration.

Figure 13:
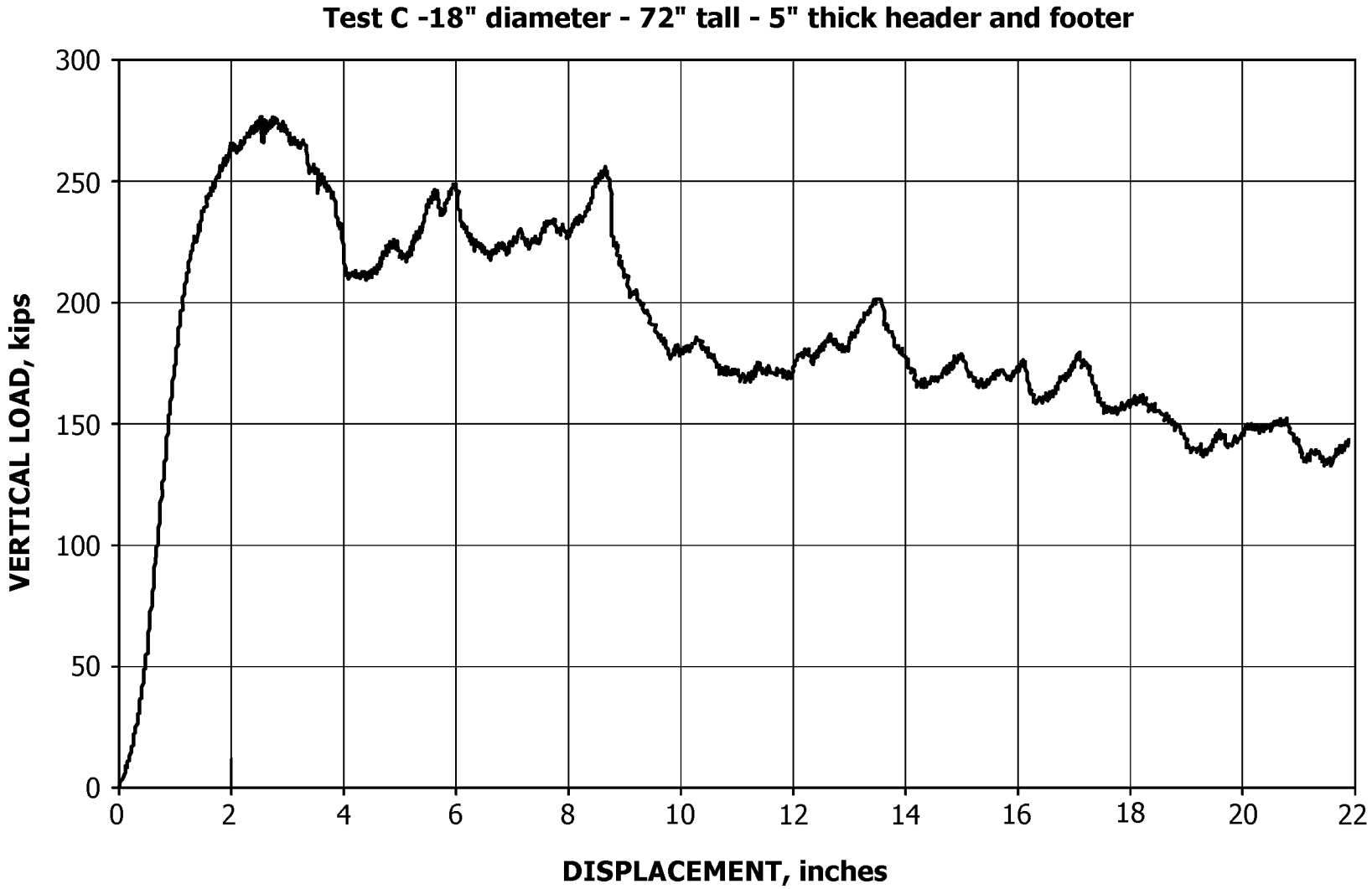
FIG. 13 is a graphs of a load profile of a sixth embodiment of the roof support.

FIG. 13 shows still another graphical profile of a fifth exemplary test with an embodiment of the bamboo support. The support in FIG. 13 was 18 inches in diameter and 72 inches high, with a 5 inch header and footer. Peak vertical load was approximately 270 kips at 3 inches of displacement, and residual load tapered gradually to approximately 145 kips vertical load at 22 inches of displacement. Additional tests on supports of the same dimensions yielded test results ranging from a maximum peak vertical load of approximately 360 kips at 4.5 inches of displacement, to a minimum peak vertical load of approximately 125 kips at 17 inches of displacement. Residual measurements at 22 inches of displacement were between 150 kips and 170 kips.

Figure 12:
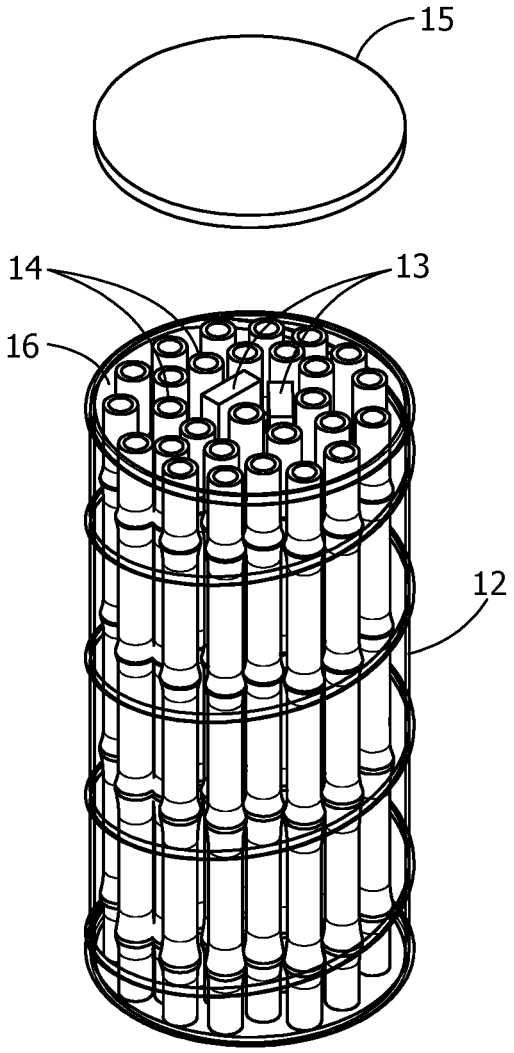
FIG. 12 shows an alternate embodiment of a roof support of the present invention, including lumber segments interspersed with bamboo sections.

Referring next to FIG. 12, in an alternate embodiment of a roof support of the present invention, lumber segments 13 interspersed with bamboo sections 14. The placement of inexpensive two-by-four lumber segments 15 within the casing further reduces the cost of materials while substantially maintaining the load capacity of the roof support. Of course sizes and amounts of the mix can be adjusted to provide a mixed matrix for adjustable performances. By way of example and not limitation, dimensions may include two-by-six, two-by-eight, two-by-ten, and similarly configured lumber segments. An optional cap 15 may be inserted at either end of the support 10, or both ends of support to protect the bamboo sections 14 and polyurethane contents within the cladding 12, and to distribute load evenly across the support 10.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the mine roof/structural support as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

It should be noted that although the figures herein may show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

What is claimed is:

1. A roof support apparatus comprising a cylindrical cladding defining a hollow interior, a plurality of bamboo sections disposed in the hollow interior; the bamboo sections extending coaxial with an axis of the cylinder; wherein each of the plurality bamboo sections comprises a hollow core; and wherein the hollow core having PUR foam filler therein to provide additional strength.

2. The apparatus of claim 1, wherein the cylindrical cladding extends longitudinally from a bottom end to a top end of the roof support apparatus.

3. The apparatus of claim 1, further comprising at least one void disposed between adjacent bamboo sections.

4. The apparatus of claim 3, wherein the at least one void comprises a filler material injected therein.

5. The apparatus of claim 4, wherein the filler material comprises a polyurethane foam.

6. The apparatus of claim 5, wherein the filler material being injected into the void, the filler material configured to maintain axial positioning of the bamboo sections when the roof support apparatus is placed under a load.

7. The apparatus of claim 6, wherein the roof support apparatus is configured to yield under a load to control a mine roof from sudden failure.

8. The apparatus of claim 1, wherein the roof support cladding comprises a spiral cladding formed from sheet steel with the plurality of bamboo sections having diameters varying from 2.54 cm to 10.16 cm; and wherein the voids in the cladding are filled with PUR around the bamboo.

9. The apparatus of claim 8, wherein at least two bamboo sections are discontinuous over the axial length of the support apparatus; the discontinuous sections being arranged in a plurality of pieces along the axial length.

10. The apparatus of claim 1, wherein the roof support apparatus is about 30.48 centimeters (cm) (12 inches) in diameter by 152.4 cm long (60 inches) in length and the voids in the cladding include PUR around the bamboo; and wherein the peak tonnage capacity is 96161 kilograms.

11. A roof support apparatus comprising a cylindrical cladding defining a hollow interior, a plurality of bamboo sections disposed in the hollow interior and positioned within the cladding substantially coaxial with an axis of the cladding, wherein the adjacent bamboo sections define a plurality of voids therebetween; wherein each of the plurality bamboo sections comprises a hollow core; and wherein the hollow core having PUR foam filler therein to provide additional strength.

12. The apparatus of claim 11, further comprising a filler material injected into the voids.

13. The apparatus of claim 12, wherein the filler material comprises polyurethane foam.

14. The apparatus of claim 12, wherein the filler material is configured to maintain axial positioning of the bamboo sections when the apparatus is placed under load.

15. The apparatus of claim 11, further comprising a plurality of lumber sections placed within the cylindrical casing of the roof support adjacent one or more of the plurality of bamboo sections.

16. The apparatus of claim 11, wherein the plurality of bamboo sections having various sizes.

17. The apparatus of claim 11, wherein the support apparatus further comprises has a first end and a second end, each of the first and second end substantially open or covered by an end cap; the first end being positioned directly adjacent a mine roof.

18. The apparatus of claim 11, wherein the support apparatus further comprises has a first end and a second end, each of the first and second end substantially open or covered by an end cap; the first end being positioned adjacent a mine roof, and comprising a yield ring inserted between the first end and the mine roof; the second end in direct contact with a mine floor or other structure.

19. The apparatus of claim 11, wherein the cladding comprises spiral tubing having a predetermined pitch.

20. A roof support apparatus comprising a cylindrical cladding defining a hollow interior, a plurality of bamboo sections disposed in the hollow interior and positioned within the cladding substantially coaxial with an axis of the cladding, wherein the adjacent bamboo sections define a plurality of voids therebetween; and a plurality of lumber sections placed within the cylindrical casing of the roof support adjacent one or more of the plurality of bamboo sections.

* * * * *